US005645353A

United States Patent [19]

Linnell et al.

[11] Patent Number: 5,645,353

[45] Date of Patent: Jul. 8, 1997

[54] MAIL BAGS

[76] Inventors: Michael Charles Linnell; Linda Rose Linnell, both of 94 Abbey Road, Barking, Essex IG11 7BT, England

[21] Appl. No.: 171,262

[22] Filed: Dec. 21, 1993

Related U.S. Application Data

[63] Continuation of Ser. No. 777,368, filed as PCT/GB90/00757, May 16, 1990, abandoned.

[30] Foreign Application Priority Data

May 23, 1989 [GB] United Kingdom ..... 8911780

[51] Int. Cl.[6] ..... B65D 33/02; B65D 33/14

[52] U.S. Cl. ..... 383/22; 383/34.1; 220/404; 493/226

[58] Field of Search ..... 383/22, 23, 24, 383/33, 34, 34.1, 6; 248/339, 340, 312.1, 99, 100; 493/226, 926; 220/404

[56] References Cited

U.S. PATENT DOCUMENTS

| | | | |
|---|---|---|---|
| 502,520 | 8/1893 | Latcher | 383/24 |
| 529,690 | 11/1894 | Arkell et al. | 383/117 |
| 658,729 | 9/1900 | Steele | 383/24 |
| 683,153 | 9/1901 | Steele | 383/24 |
| 860,183 | 7/1907 | Barr | 383/34.1 |
| 928,106 | 7/1909 | Carpenter | 383/24 |
| 1,378,050 | 5/1921 | Morris | 248/99 |
| 2,325,853 | 8/1943 | Harlem | 383/33 |
| 2,468,897 | 5/1949 | Rothe | 383/22 |
| 2,513,040 | 6/1950 | Miller | 383/6 |
| 3,156,206 | 11/1964 | Hall et al. | 493/226 |
| 3,362,302 | 1/1968 | Friedman | 383/6 |
| 3,463,381 | 8/1969 | Wainberg | 383/34 |
| 3,559,873 | 2/1971 | Hart | 383/6 |
| 4,450,580 | 5/1984 | Lindsay | 383/6 |
| 4,524,457 | 6/1985 | Marino | 383/24 |
| 4,694,503 | 9/1987 | Hydorn | 383/12 |
| 4,815,866 | 3/1989 | Martone | 383/34.1 |
| 5,125,605 | 6/1992 | Guerrera | 248/100 |

FOREIGN PATENT DOCUMENTS

| | | | |
|---|---|---|---|
| 2633253 | 12/1989 | France | 383/24 |

*Primary Examiner*—Stephen P. Garbe
*Attorney, Agent, or Firm*—Bauer & Schaffer

[57] ABSTRACT

A plurality of supports are arranged about the periphery of the mouth of a fabric mail bag. The supports are formed of an elongate first part and an apertured second part. The supports have their first parts permanently secured to the fabric of the bag so that then second parts extend orthogonally therefrom. The supports serve to attach the bag to external supports and to normally bias the mouth open.

19 Claims, 3 Drawing Sheets

MAIL BAGS

Figure 1A:
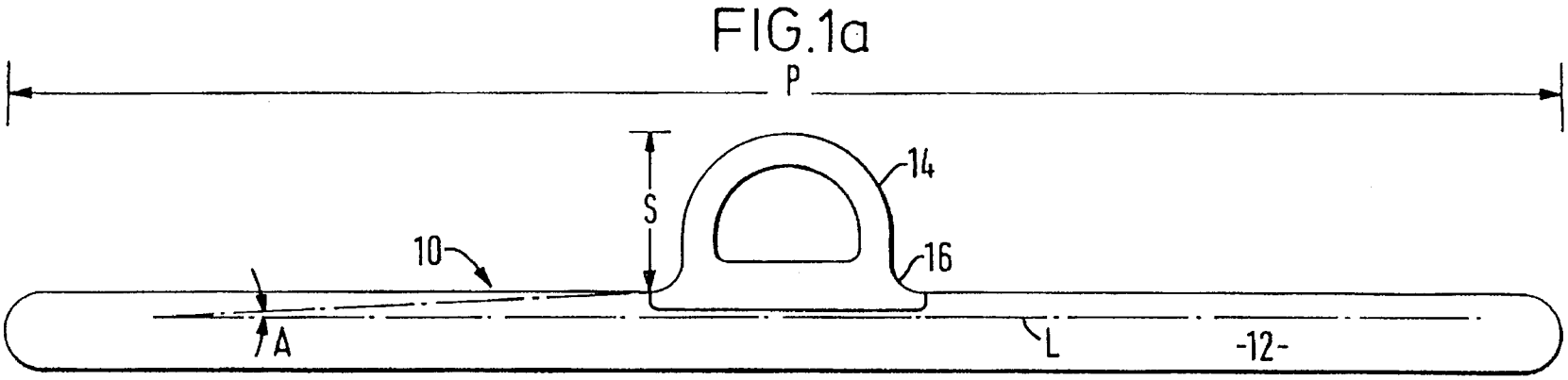

This is a continuation of Ser. No. 07/777,368, filed as PCT/GB90/00757, May 16, 1990 now abandoned.

The invention relates to improved bags and sacks, methods of making same and parts therefore.

Bags and sacks (hereinafter referred to simply as bags) are used for many purposes, and the invention is particularly concerned with an improved form of mail bag.

BACKGROUND ART

Mail bags are well known and are used to store mail as it is carried e.g. from a collection point to a sorting office and between sorting offices. In use in sorting offices the mail bags are supported open in a frame so that mail may be readily thrown into them. To achieve this it is the practice to provide each mail bag with a plurality of (usually four) metal D-rings at equi-spaced locations along the edges of the mouth of the bag which are engaged by hooks in the frame. The D-rings are attached to mail bags by being stitched into a fold midway along the length of a swathe of fabric (which to provide adequate strength has usually been formed by pre-folding and prestitching) the two ends of the swathe being located on either side of the top edge of the bag (with the D-ring substantially in the plain of that edge) and stitched onto the fabric of the bag.

To ensure that the mouth of the bag tends to stay open whilst it is in the frame (particularly when it is relatively empty) the edge of the mouth of the bag—to which the D-rings are attached—is usually provided with a stitched in rope or cord which, whilst being sufficiently flexible to allow the bag to be closed, acts to hold the mouth open whilst the bag is held by the hooks in the frame. This rope or cord is usually located in a top hem provided for the fabric of the mail bag as the bag is being made up.

Thus it will be seen that the manufacture of a mail bag necessarily includes a number of steps which need to be performed before the bag can be made up. These may be summarized as follows:

Manufacture of the D-ring supports;

1. Slitting the fabric into appropriate width swathes,
2. Folding over the edges of the swathes and stitching along the side edges of the swathe,
3. Cutting the swathes to length and at the same time heat sealing the ends of the cut lengths, and
4. Folding the cut swathes over the straight arm of the D-ring and stitching across the swathe to hold the D-ring in position, Thereafter the manufacture of a mail bag requires the further steps of:

6. Cutting the bag fabric to the correct length (it is assumed that it is provided at the correct width),
7. Accurately folding and stitching the cut fabric to provide a top hem at the mouth and side and bottom seams of the bag,
8. Fitting a rope or cord into the hem formed at the bag mouth, and
9. Locating the free ends of the fabric of the D-ring support to either side of the top of the bag mouth and then stitching those free ends onto the fabric of the bag, Thus it will be seen that the manufacture of a complete mail bag takes, on the above analysis, nine separate operations—and it is to be noted that thus analysis does not include the folding, stacking and transportation of the part made bag and D-ring supports, between operatives performing each of the noted operations.

It will be seen from the above the known type of bag is that it is costly to produce—in terms both of materials (bag fabric, rope or cord, metal D-rings and the additional fabric required to form the swathes holding the D-rings on the mail bag) and of operations required to make up the bag.

Again, the known mail bags which include a rope or cord, D-rings and additional fabric required to hold the D-rings in position are significantly heavier than might otherwise be the case making the cost of transporting the mail bag greater than might otherwise be the case (whether filled or unfilled) particularly when it is being transported as air cargo.

A first object of this invention is the provision of a new form of mail bag which alleviates and/or overcomes these drawbacks.

A second object of the invention is to provide a support for a mail bag which may be readily attached to the mail bag at a desired location to enable the bag to be supported and which is of significantly less weight than the known, D-ring supports, used at present.

A third object of the invention is to provide a method of making mail bags which is significantly less costly—in terms both of the material used and the number of operations required—than is the case with the known mail bags.

SUMMARY OF THE INVENTION

In one aspect the invention provides a mail bag having at least one support adjacent the mouth thereof by means of which the bag may be supported open, wherein the or each support comprises an elongate part fixed to the fabric of the bag with its longitudinal axis generally parallel to the edge of the mouth of the bag and attaching means attached to or formed integrally with said elongate part by means of which in use the bag may be supported.

There may be provided a plurality of supports adjacent the mouth of the bag, the elongate part of each support being resilient and said attaching means of each support comprising at least one attachment member formed integrally partway along the length of said elongate part to extending generally orthogonally of the longitudinal axis of said elongate part.

Preferably the elongate first part of each support is generally flat and said attachment member is formed on an edge thereof.

In one arrangement embodying the invention there are provided four supports, the length of the elongate part of each support being substantially equal to or less than one quarter of the length of the edge of the mouth of the bag the attachment members being formed substantially at the midpoints of the elongate parts.

In another derangement embodying the invention there are provided two supports, the length of the elongate part of each being substantially equal to or less than one half of the length of the edge of the mouth of the bag, each said elongate part being foldable substantially at it's midpoint and having a pair of attachment members formed at respective locations substantially midway between the ends thereof and said midpoint.

Desirably each attachment member has an aperture for receiving a hook member by means of which the bag may be supported.

Each support may be attached to the fabric of the bag by locating the elongate part thereof within a hem formed at the mouth of the bag with said attachment member passing through an aperture in the fabric of the hem to a position in which it may be engaged by a said hook.

Alternatively, and preferably we provide that the elongate part of the or each support is directly fixed to the fabric of the bag—desirably—sewn onto the fabric of the bag as the bag is being made.

Each support may be of a moulded plastics material and advantageously the supports are of moulded polypropelene and the fabric of the bags is woven polypropelene.

A second aspect of the invention provides a moulded plastics support for use in making a mail bag as defined above which support comprises an elongate part attachable to the fabric of the bag adjacent the mouth of the bag and formed integrally with attachment means at one or more locations along the length thereof to extend generally orthogonally of the axis of the elongate part.

In this second aspect the elongate part is preferably generally flat and said attachment means comprises an apertured attachment member formed substantially at the midpoint of a longitudinally extending edge thereof to extend generally normally away therefrom and wherein the support is of a material such that it may be sewn onto the fabric of a mail bag.

Alternatively the elongate part may be generally flat and foldable substantially at it's midpoint, and said attachment comprise a pair of apertured attachment members formed at respective locations substantially midway between the ends thereof and said midpoint on the edge thereof to extend generally normally away therefrom, and wherein the support is of a material such that it may be sewn onto the fabric of a mail bag.

A third aspect of the invention provides a method of making a mail bag using supports as defined above, including the steps of folding and stitching edges of the piece of fabric to form a bag and fixing the elongate part of each support to the fabric of the bag with the support adjacent the mouth thereof such that the attachment means of each support extends above the mouth of the bag.

Preferably the method provides the steps of locating supports such that the elongate part of each support is adjacent and parallel to a folded edge of a piece of fabric and their longitudinal axes are substantially aligned, stitching the elongate part of each support to the folded edge of fabric and folding the fabric and stitching other edges thereof so as to form a bag with the attachment member of each support extending above the mouth of the bag.

Desirably the method includes the step of using fabric adapted to indicate the locations at which the or each elongate part of a support is to be located—advantageously, the fabric used has stripes of different colours woven thereinto, the spacing of the stripes being in substance the same as the length of the elongate members of the supports to be fixed to the fabric in making the mail bag.

EMBODIMENTS OF THE INVENTION

Figure 1B:
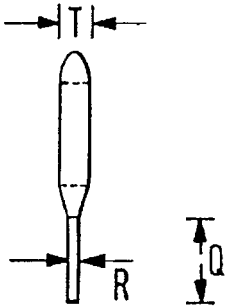
Figure 2B:
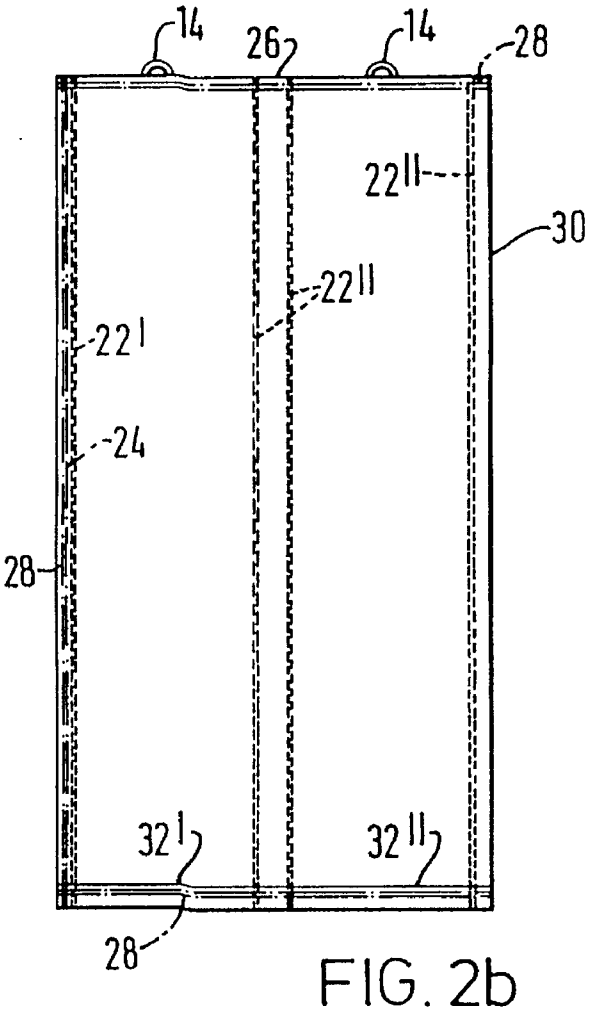
Figure 2A:
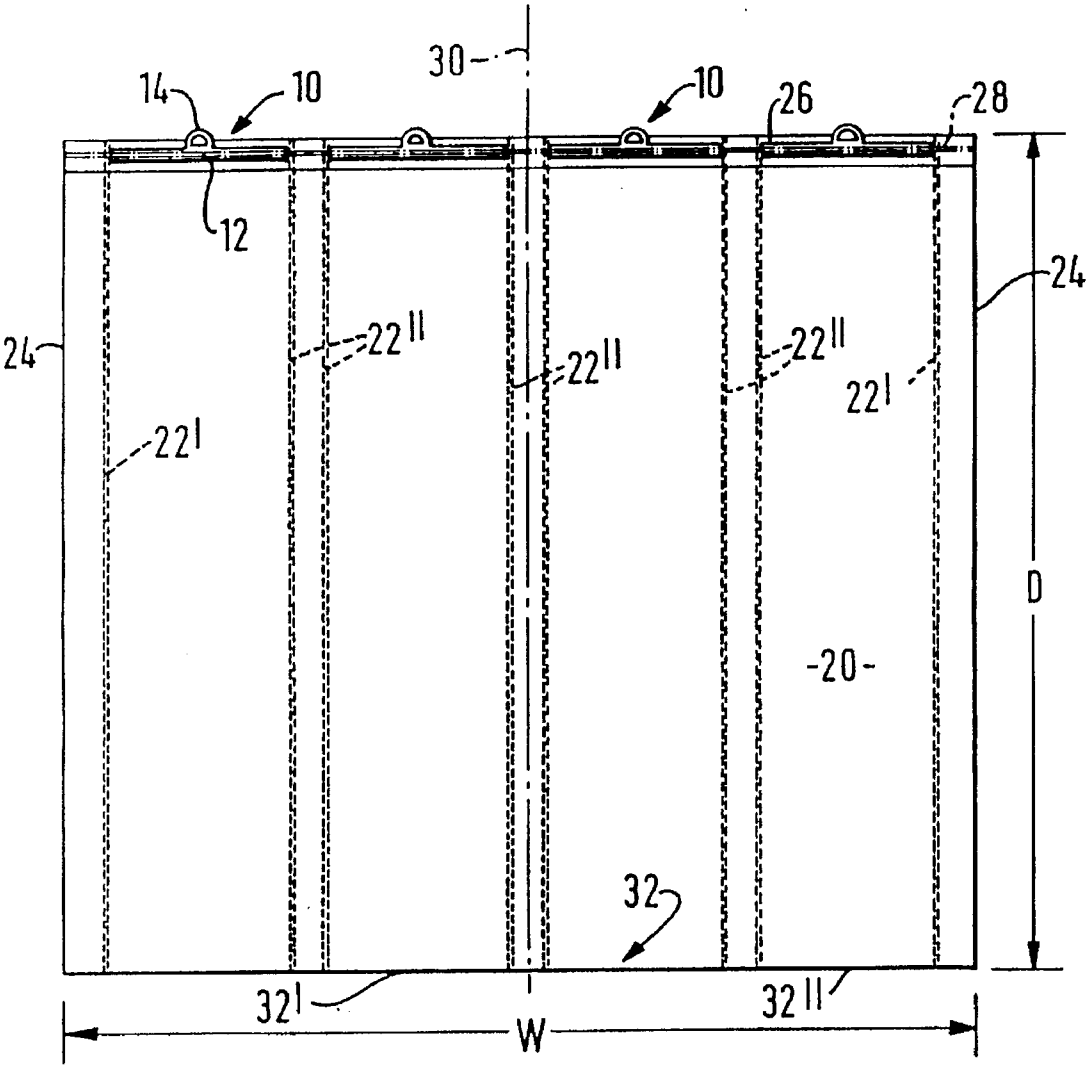
Figure 3:
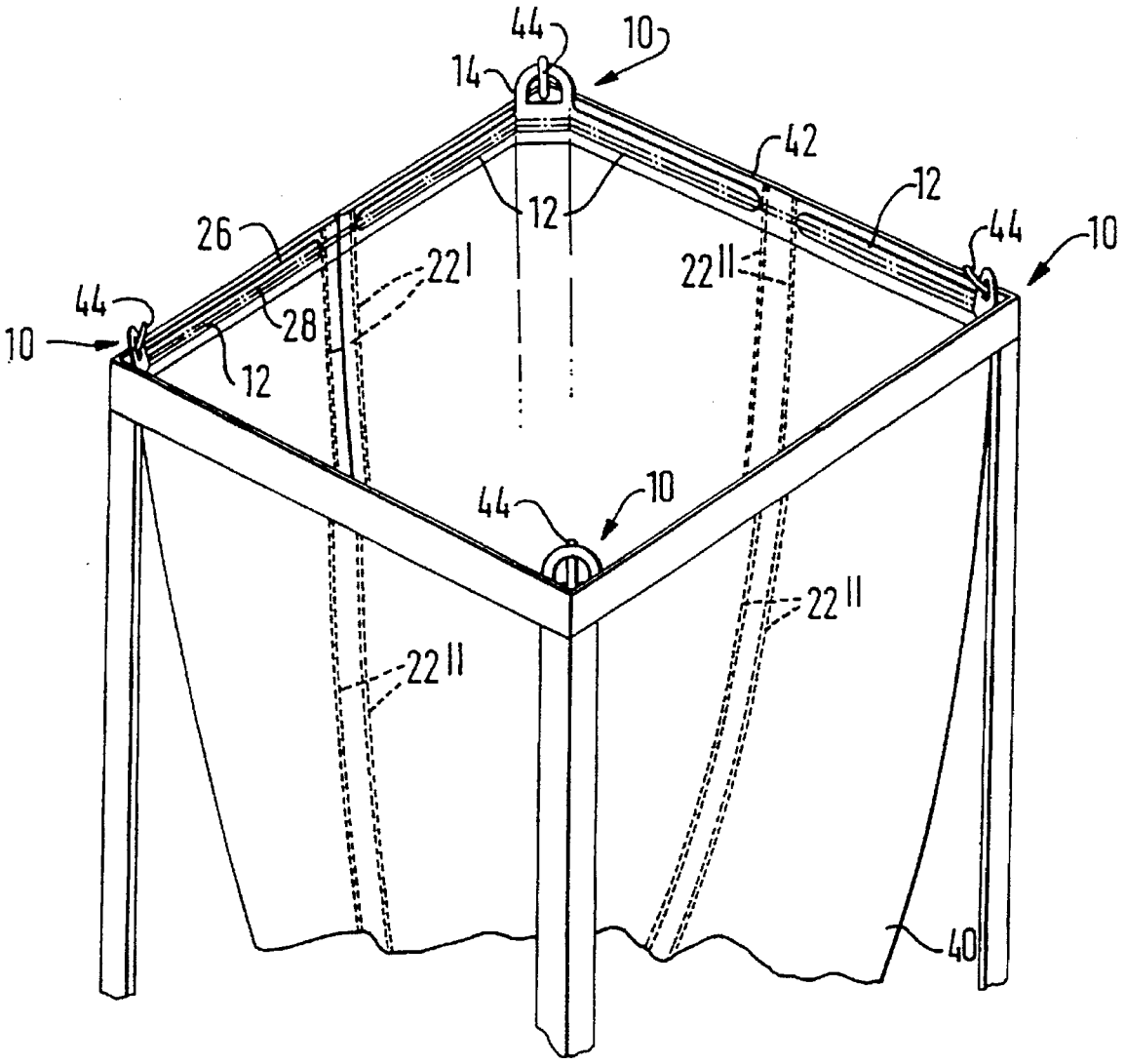

The above and other aspects, features and advantages of the invention will become apparent from the following description of an embodiment of the invention made with reference to the accompanying drawings, in which:

FIG. 1 shows at A and B respectively side and end views of a support in accordance with the invention, FIG. 2 illustrates at A a stage in the method embodying the invention of making a mail bag and at B a completed mail bag, FIG. 3 illustrates a mail bag made in accordance with the invention supported in a frame, and FIG. 4 illustrates at A and B alternatives to the embodiments described with reference to FIGS. 1 to 3

With reference now to FIGS. 1 and 2, a support 10 is shown to comprise an elongate part 12 of length P, height Q and thickness R. On one edge of Part 12, substantially at its midpoint there is provided a member 14 of height S and thickness T. In this embodiment of the support the height S and thickness T of member 14 are respectively greater than the height Q and thickness R of the elongate part 12 of support 10.

Member 14 is generally of the D-shape shown and the corners 16 where it meets the elongate part 12 are curved to increase the strength of support 10.

Support 10 is moulded in one piece from polypropelene.

The elongate part 12 may be provided with upper and lower edges which run parallel to the longitudinal axis L of the part 12 or, preferably, be provided running at slight, upwardly extending angles A (not more than 3°) to that axis as shown in FIG. 1A.

FIG. 2A illustrates a stage in the manufacture of a mail bag in accordance with one embodiment of the invention and shows four supports 10 correctly positioned for attachment to a piece of woven polypropelene fabric being made up into a mail bag.

The piece of fabric 20 is provided at the desired width W which will, when the bag is made up, be substantially equal to the length of the edge of the bag mouth. It will be noted that the polypropelene material as provided has woven thereinto a series of stripes 22 running along its length.

The arrangement of the stripes 22—which are preferably provided by weaving polypropelene of a different colour into the main body of the fabric piece 20, are positioned generally as shown.

It will be noted that an outer pair of stripes 22' are spaced a short distance in from the outer edges 24 of the fabric piece 20 and that there are a further six stripes 22" arranged in three pairs running the length of the fabric. The spacing of the pairs of stripes 22" one from the other, and of those pairs of stripes from the outermost stripes 22' is substantially the same, or very slightly greater, than the dimension P of the elongate part 12 of the support 10.

To make the mail bag in accordance with the invention the piece of fabric 20 is first cut to length D as shown. Thereafter the top edge 26 is folded as indicated and the supports 10 are positioned on that folded top edge as shown. The stripes 22 provided in the fabric enable the accurate positioning of the elongate parts 12 of the supports 10 in the locations at which they are to be fixed to the fabric piece 20. The operative then simply stitches across the fold 26—as indicated at 28—to form a hem for the bag mouth and at the same time stitches through the relatively soft elongate parts 12 of the supports 10 to hold the supports on the fabric piece 20.

It will be seen that the length P of the elongate part 12 of each support 10 is just less than a quarter of the width W of fabric 20, thereby enabling the piece of fabric 20 to be folded about it's centre line (shown dotted at 30) to bring the opposed side edges 24—and the two halves 32' and 32" of the bottom edge 32—of the piece of fabric 20 into register one with the other.

After the fabric piece 20 has been folded in this way the operative grasps the two edges 24 and folds them back until they are in register with the outermost lines 22' woven into the fabric piece 20. He or she then simply machine stitches down the length D of the fabric piece to form the side seam of the mail bag.

Thereafter the mail bag is completed by folding the two halves 36' and 36" of the bottom edge up and stitching across the bottom of the fabric piece 20 to form the completed bag as illustrated in FIG. 2B.

To prevent the fabric edges fraying when the mail bag is in use these edges may—before the supports 10 are attached to the piece of cloth 20—be heat treated in a known manner. Alternatively, they may be tack hemmed or reinforced with strips of the same or another fabric if desired.

FIG. 3 shows a mail bag 40 made in accordance with the above described method in use supported in a square frame 42 by means of hooks 44 at the corners of the frame. Each hook 44 passes through a respective one of the four members 14 of the bag. It will be seen that the elongate parts 12 of the four supports 10 are forced to adopt the position shown and that their natural resilience acts to hold the mouth of the mail bag 40 open. As seen in FIG. 3, the supports 12 are arranged along the width W of the bag forming material (i.e. about its periphery when formed) so that their ends are in end to end spaced relationship, leaving a small area between them free. Thus, when the bag is removed from the hooks 44, the supports 12 can be folded over themselves, permitting the frame and bag to be opened and closed.

It will be appreciated that there are many modifications which may be made to the arrangements so far described without departing from the scope of the invention and some of these are illustrated in FIG. 4.

Figure 4B:
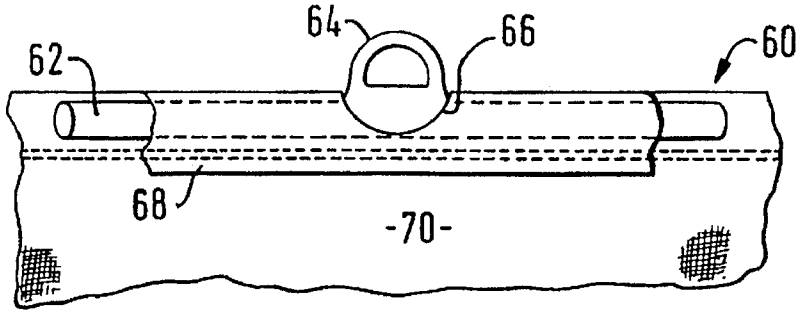
Figure 4A:
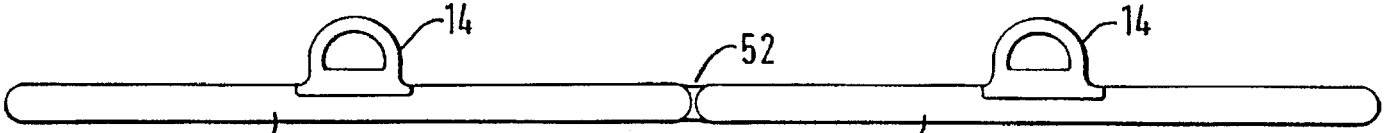

FIG. 4A illustrates a modified form of support 10 having a single elongate part 50 substantially twice the length of the elongate parts 12 described above. The elongate part 50 is formed at it's midpoint with a portion of reduced thickness 52 which divides the elongate part 50 into two halves 50' and 50" as shown.

The elongate part 50 is foldable about its midpoint 52 and each half 50' and 50" of it is formed—at a location midway between it's free end and the midpoint of the elongate part 50—with an attachment member 14 as described above. It will be appreciated that a support such as shown in FIG. 4A may be used in place of two of the supports described with reference to FIGS. 1 to 3 in the manufacture of a mail bag—the two halves 50' and 50" of the elongate part 50 being able rotate relative to one another about the portion of reduced thickness 52—and tend to hold the mouth of the mail bag open whilst it is supported in the frame 42.

It will further be appreciated that the four supports described with reference to FIGS. 1 to 3 may if desired be replaced by a single support having an elongate part substantially four times as long as the elongate parts 12—being separated by three portions of reduced thickness dividing the elongate part into four quarters—each of which is formed—at it's midpoint with a attachment member 14 as described above.

The particular form of the support may be varied if desired from that shown 10—the length P, height Q and thickness R of the elongate first part 12 may be altered as desired as may the height S and thickness T of the attachment member 14—providing always that the elongate part acts when attached to the mail bag in the manner described with reference to FIG. 3.

Again the manner in which the support is attached to the fabric of the mail bag may be varied.

A modified way of attaching a support of different form to those already described is illustrated in FIG. 4B which shows a support 60 to comprise an elongate part 62 of rod-like form and having an attachment member 64 formed half way along it's length to extend in a plane including the axis of the elongate part 62.

The fabric of the piece of cloth to form the mail bag is pierced at 66 by a slot the length of which is in substance the same as the dimension of the attachment member 64 measured along the length of the elongate part 62.

To attach the support 60 to the fabric of the mail bag the support is placed on the fabric and the attachment member 64 passed through slot 66, thereafter the outer edge 68 of the fabric is folded over the elongate part 62 and stitched onto the main part 70 of the fabric to form a hem in which the elongate first part 62 is located—the slot 66 through which the attachment member 64 extends being at the upper edge of the bag.

The method of attaching a support to a mail bag described with reference to FIG. 4B is not of course limited to form of support 60 there described—the same method of attachment may, if desired be used for the supports described with reference to the earlier described Figures.

It will be seen that other variations to the described arrangements may be made without departing from the scope of the invention.

The attachment member and elongate parts of any support may be separable, or be formed separately and thereafter fixedly attached one to the other. The support may be of dimensions and materials other than those specifically described—particularly if the fabric from which the mail bag is woven is different (e.g. canvas) and requires that the degree of support to be given by the support is greater (or less) than that required to satisfactorily support the bag in a frame and hold open the mouth of the mail bag whilst it is in the frame.

Although described as being of polypropelene—a material which may simply be stitched through by a commercial sewing machine—it will be appreciated that the material of the support and in particular of the elongate part thereof may be of any material and may be pre-formed with holes through which a thread may be passed in a stitching operation to attach the support to the piece of cloth to form the mail bag.

Again, although the preferred methods of attaching the support to the piece of cloth forming the mail bag are those described it will be appreciated that any other suitable method (welding, glueing, pinning or rivetting) may be employed without departing from the scope of this invention.

INDUSTRIAL APPLICABILITY

It will be seen from the foregoing that mail bags embodying the present invention are more simply made than mail bags presently known to us in that they simply require;

1. That the fabric for forming the bags be cut to length,
2. That the top edge of the cut fabric length be folded and the supports be accurately positioned (with the aid of the stripes pre-formed in the fabric), and
3. That the top, side and bottom edges of the fabric piece be stitched to form the bag, with the supports in position.

It will be appreciated that the number of operations required to make a bag in accordance with the present invention is reduced compared with the number of operations required to make a mail bag of traditional form—leading to a significant saving in the cost of making the bag.

Furthermore it will be noted that the arrangement described provides that relatively lightweight polypropelene supports 10 are used and that these are fixed directly onto the fabric of the mail bag without the need for additional fabric. For this reason the weight of a mail bag embodying the present invention is substantially less (approximately one half) the weight of a mail bag made of the same fabric material but using the traditional metal D-rings held in position by swathes of fabric stitched onto the upper edge of the bag—and including a rope or cord passed through an upper hem of the bag.

For this reason bags made in accordance with the present invention have significant cost advantages over traditionally made bags when being transported—either filled or empty—especially as air cargo.

We claim:

1. In a fabric bag, a frame for supporting the mouth of the bag, said frame comprising four generally flat and elongate parts, the length of each of which is no greater than substantially equal to one-quarter of the length of the perimeter of the mouth of the bag, said elongate parts being formed integrally with an apertured attaching member substantially at the midpoint of a longitudinally extending edge thereof to extend generally normally away therefrom, each of said elongate parts being bendable with respect to the vertical axis of its attaching member, said elongate parts are of a flexible moulded plastics material sewn to the fabric of the bag to attach the support to the fabric of the bag adjacent the mouth of the bag with the apertured attaching member extending generally orthogonally of the free edge of the bag, said elongate parts being arranged in spaced end to end relationship from each other, permitting the opening of said bag when said elongate parts are bent and closing of the mouth when said elongate parts are folded over each other.

2. In a fabric bag a frame for supporting the mouth of the bag, said frame comprising two elongate parts, the length of each of which is no greater than substantially equal to one-half of the length of the perimeter of the mouth of the bag, said elongate parts being bendable substantially at their midpoint and formed integrally with a pair of apertured attaching members located respectively between the ends thereof and said midpoint on a longitudinal edge thereof to extend generally normally away therefrom, said elongate parts being formed of a flexible moulded plastics material such that the elongate parts may be sewn to the fabric of the bag with the apertured attaching members extending orthogonally of the free edge of the bag, said elongate parts being arranged in spaced end to end relationship from each other when said elongate parts are bent, permitting the opening and closing of the mouth when said elongate parts are folded over each other.

3. A mail bag comprising a bag-shaped body formed of fabric material having a free edge defining a mouth, a plurality of elongated hangers, each having one edge extending substantially parallel to the longitudinal axis of the perimeter of the mouth of the bag and attaching means located partway along the length of said one edge with its vertical axis extending and intersecting generally orthogonally to said one edge for hanging said bag from a support, said plurality of hangers being spaced end to end from each other and secured to the fabric separately from each other about the free edge of said fabric, permitting the opening and closing of the mouth, each of said hangers being formed of resilient material bendable with respect to the vertical axis of its attaching means so that the free edge of said fabric is distendible to define the mouth in open position when hung on said support.

4. A mail bag as claimed in claim 3 wherein said hangers comprise a number of flexible, generally flat, elongate parts permanently secured to the fabric of the body and four attachment members attached to or formed integrally with an edge of the elongate parts partway along the length of the hanger to extend generally orthogonally therefrom said attachment member having an aperture for receiving a hook so that said body may be supported by said attaching members.

5. A mail bag as claimed in claim 4, wherein the length of each elongate part is no greater than substantially equal to one-quarter of the length of the free edge defining the mouth of the bag and wherein an attachment member is formed substantially at the midpoint of each elongate parts.

6. A mail bag as claimed in claim 5, wherein each of said supports is of a moulded plastics material.

7. A mail bag as claimed in claim 6, wherein each of said supports is of a moulded polypropylene and the fabric of the bag is woven polypropylene fabric.

8. A mail bag as claimed in claim 4, wherein the length of each elongate part support is no greater than substantially equal to one-half of the length of the free edge defining the mouth of the bag, each said elongate part being foldable substantially at its midpoint and having a pair of attachment members formed at respective locations substantially midway between the ends thereof and said midpoint.

9. A mail bag as claimed in claim 8, wherein each of said supports is of a moulded plastics material.

10. A mail bag as claimed in claim 9, wherein each of said supports is of a moulded polypropylene and the fabric of the bag is woven polypropylene fabric.

11. A mail bag as claimed in claim 3, wherein the free edge of said bag is folded to form a hem at the mouth thereof, said hem having an aperture for each attachment member, each of said elongate parts being located within said hem and said attachment members passing through a respective aperture to a position in which said attachment member may be engaged by the hook.

12. A mail bag as claimed in claim 11, wherein each elongate part is sewn onto the fabric of the bag.

13. A method of making a fabric mail bag including the steps of cutting, folding and stitching edges of a piece of fabric to form a bag open at one end the free edge of which defines a mouth, permanently securing supporting means to the fabric of the bag, said supporting means comprising four flexible elongate first parts, the length of each said elongate first part being no greater than substantially equal to one-quarter of the length of said free edge, each flexible elongate first part having formed integrally therewith an apertured attachment member, said attachment member extending orthogonally of the longitudinal axes of the elongate first part with which it is associated, and such that said attachment members extend above the mouth of the bag.

14. A method of making a fabric mail bag as claimed in claim 13, wherein the fabric adjacent the mouth of the bag is apertured and said attachment members are passed through said apertures, the fabric of the bag being folded over said flexible elongate parts from the folded edge having an axis parallel to the axes of the elongate parts with the elongate parts substantially aligned, and thereafter stitching said fabric at the folded edge so as to permanently join the flexible elongate members to the fabric of the bag, thereafter forming a bag by folding said fabric and stitching remaining edges to form a bag having a mouth defined by the folded edge with the attachment members extending above said mouth.

15. A method of making a mail bag as claimed in claim 13, further including the steps of using fabric marked to indicate the location at which the elongate part of each of said supports is to be positioned.

16. A method as claimed in claim 15, wherein said fabric has stripes of different colours woven thereinto, the spacing of the stripes being in substance the same as the length of the elongate members of the supports to be fixed to the fabric in making the mail bag.

17. A method of making a fabric mail bag including the steps of cutting, folding and stitching edges of a piece of fabric to form a bag open at one end, the free edge of which defines a mouth, permanently securing supporting means to the fabric of the bag, said supporting means comprising two flexible, elongate first parts, each of which is foldable substantially at its midpoint and each of which is provided with two apertured attachment members formed integrally with the elongate first part at locations substantially halfway between the ends of said elongate first part and the midpoint of said elongate first part, said apertured attachment members extending orthogonally of the longitudinal axis of the elongate first part, and such that said attachment members extend above the mouth of the bag.

18. A method of making a mail bag as claimed in claim 17, further including the steps of using fabric marked to indicate the location at which the elongate part of each of said supports is to be positioned.

19. A method as claimed in claim 18, wherein said fabric has stripes of different colours woven thereinto, the spacing of the stripes being in substance the same as the length of the elongate members of the supports to be fixed to the fabric in making the mail bag.

* * * * *